US012385251B2

(12) United States Patent
Noble

(10) Patent No.: US 12,385,251 B2
(45) Date of Patent: Aug. 12, 2025

(54) POLYMER CONSTRUCTION STUDS AND SHEATHING

(71) Applicant: Steven H. Noble, Sartell, MN (US)

(72) Inventor: Steven H. Noble, Sartell, MN (US)

(73) Assignee: ForestFree Synthetics Building Products, LLC, Spicewood, TX (US)

( * ) Notice: Subject to any disclaimer, the term of this patent is extended or adjusted under 35 U.S.C. 154(b) by 207 days.

(21) Appl. No.: 18/150,178

(22) Filed: Jan. 4, 2023

(65) Prior Publication Data

US 2024/0093493 A1 Mar. 21, 2024

Related U.S. Application Data

(60) Provisional application No. 63/367,748, filed on Jul. 6, 2022, provisional application No. 63/296,330, filed on Jan. 4, 2022.

(51) Int. Cl.
*E04C 3/36* (2006.01)

(52) U.S. Cl.
CPC ..... *E04C 3/36* (2013.01)

(58) Field of Classification Search
CPC ..... E04C 3/36; E04C 3/32; E04C 3/34
See application file for complete search history.

(56) References Cited

U.S. PATENT DOCUMENTS 2,880,470 A 4/1959 Pickersgill
3,274,315 A * 9/1966 Kawamura ..... B29C 48/335 428/116
3,364,638 A 1/1968 Santangelo
D211,517 S 6/1968 Pottiez
3,435,575 A 4/1969 Pottiez
3,450,593 A 6/1969 Fossier et al.
3,662,507 A 5/1972 Espeland
3,732,138 A 5/1973 Almog
3,783,563 A 1/1974 Moore
3,819,466 A 6/1974 Winfield et al.
3,886,705 A 6/1975 Cornland
(Continued)

OTHER PUBLICATIONS

International Search Report, 2 pgs, Nov. 27, 2023.
(Continued)

*Primary Examiner* — Rodney Mintz
(74) *Attorney, Agent, or Firm* — Albert W. Watkins

(57) ABSTRACT

A building construction stud and sheathing panel are affixed together by at least one fastener. A stud end cap terminates the stud. The stud has an outer wall that defines a pair of plastic sheathing faces and first and second side walls, and at least one longitudinally extensive void space. At least one fastener anchoring and structurally reinforcing member is contained substantially within the interior of the stud outer wall. In some embodiments, the fastener anchoring and structurally reinforcing member comprises a plurality of longitudinally extensive stud wall ribs protruding internally from the first sheathing face. In other embodiments, cell dividers are provided that are parallel with and spaced slightly from the first and second sheathing faces. In yet other embodiments, internal reinforcing members define an "X"-geometry within the cells. These fastener anchoring and structurally reinforcing members are configured to increase stiffness and strength, and also enhance fastener engagement.

19 Claims, 8 Drawing Sheets

(56) References Cited

U.S. PATENT DOCUMENTS 3,948,347 A 4/1976 Rutledge
3,974,612 A 8/1976 Karner
4,035,536 A 7/1977 Morrison
4,172,749 A * 10/1979 Liggett ..... B29C 65/02 156/305
4,441,291 A 4/1984 Sokoler et al.
4,606,959 A 8/1986 Hillinger
4,718,213 A 1/1988 Butterfield
4,749,601 A 6/1988 Hillinger
5,030,662 A 7/1991 Banerjie
5,052,164 A 10/1991 Sandow
5,152,119 A * 10/1992 Miller ..... E04C 3/36 52/631
5,294,472 A 3/1994 Arnold et al.
5,471,809 A 12/1995 Frankel
5,706,620 A 1/1998 De Zen
5,783,286 A 7/1998 Dinicola
5,789,477 A 8/1998 Nosker et al.
D405,545 S 2/1999 Forbis
D423,116 S 4/2000 Gregori
D431,658 S 10/2000 Gregori
6,153,293 A 11/2000 Dahl et al.
6,226,944 B1 * 5/2001 Peshkam ..... E01D 1/00 52/630
D451,612 S 12/2001 Thibault et al.
D453,045 S 1/2002 Ohanesian
6,497,956 B1 12/2002 Phillips et al.
D473,955 S 4/2003 Gregori
D474,286 S 5/2003 Gregori
6,651,398 B2 11/2003 Gregori
D485,373 S 1/2004 Morton et al.
D490,544 S 5/2004 Givoni
6,735,916 B2 * 5/2004 Peshkam ..... E04B 2/72 52/843
D500,370 S 12/2004 Givoni
6,844,040 B2 * 1/2005 Pabedinskas ..... B29C 66/45 428/188
D503,000 S 3/2005 Forbis
6,881,367 B1 4/2005 Baker
6,890,637 B2 5/2005 Baker
6,958,185 B1 10/2005 Zehner
6,986,934 B2 1/2006 Chen et al.
D531,324 S 10/2006 Takagi
7,169,460 B1 1/2007 Chen et al.
7,211,310 B2 5/2007 Chen et al.
D564,106 S 3/2008 Amato
D564,678 S 3/2008 Simko
7,419,717 B2 9/2008 Chen et al.
D585,568 S 1/2009 Kikuchi
7,763,345 B2 7/2010 Chen et al.
7,795,329 B2 9/2010 Nosker et al.
8,021,741 B2 9/2011 Chen et al.
8,065,848 B2 11/2011 Carlson et al.
8,590,271 B2 11/2013 Thiagarajan et al.
8,629,221 B2 1/2014 Nosker et al.
8,658,274 B2 2/2014 Chen et al.
8,752,348 B2 6/2014 Bowman
8,793,965 B2 * 8/2014 Kurath-Grollmann ..... B29D 24/002 52/843
8,834,992 B2 9/2014 Chen et al.
9,080,724 B2 * 7/2015 Sele ..... F17C 13/004
9,938,720 B2 * 4/2018 Urheim ..... E04C 3/005
10,357,906 B2 7/2019 Johnson, Sr.
2002/0038533 A1 * 4/2002 Potter ..... E04C 3/065 52/634
2004/0062915 A1 * 4/2004 Pabedinskas ..... B29C 48/11 428/188
2007/0028558 A1 2/2007 Lopes
2011/0268876 A1 * 11/2011 Johnson, Sr. ..... B29C 44/186 264/45.3
2016/0281362 A1 * 9/2016 Urheim ..... E04C 3/32
2023/0024343 A1 * 1/2023 Miles ..... E04B 1/19
2024/0392567 A1 * 11/2024 Felix ..... E04B 1/30

OTHER PUBLICATIONS

Written Opinion of the International Searching Authority, 8 pgs, Nov. 27, 2023.
Sizes & Profiles for Industrial Plastic Lumber by American Plastic Lumber, 4 pgs, http://american-plasticlumber.com/lumber/industrial/sizes-profiles/, downloaded Jul. 21, 2021.
Custom Plastic Co-Extrusion Services by Preferred Plastics, 6 pgs, https://www.preferredplastics.com/plastic-co-extrusion.html, downloaded Aug. 24, 2021.
Product Details by EcoStud, 2 pgs, http://ecostud.com/product-details, downloaded Jul. 21, 2021.
EVOLVE Dimensional FAQ by Renew Plastics, 3 pgs, https://www.renewplastics.com, downloaded Aug. 9, 2021.
Plastic Formwork by TRICO, 9 pgs, https://www.form-sca?s.com/plastic-formwork/, downloaded Jul. 21, 2021.
Healthy Building Networks Guide to Plastic Lumber by Institute for Local Self-Reliance, 31 pgs, 2005.
How Strong is the InSoFast Stud? By InSoFast, 12 pgs, https://www.insofast.com/explore/how-strong-is-the-insofast-stud.html, downloaded Jul. 21, 2021.
Plastic Profile Extrusions by Preferred Plastics, 6 pgs, https://www.preferredplastics.com/plastic-co-extrusion.html, downloaded Aug. 24, 2021.
How is Plastic Lumber Made? by Plastic Lumber Yard, 7 pgs, https://plasticlumberyard.com/how-is-plastic-lumber-made/, downloaded Aug. 9, 2021.
Profile Sizes for Recycled Plastic Lumber by Resco Plastics, 9 pgs, https://rescoplastics.com/resources/pro?le-sizes/, downloaded Jul. 21, 2021.
Trimax tri-fold brochure, 2 pgs, https://www.trimaxbp.com/, downloaded Aug. 9, 2021.

* cited by examiner

FIG. 26
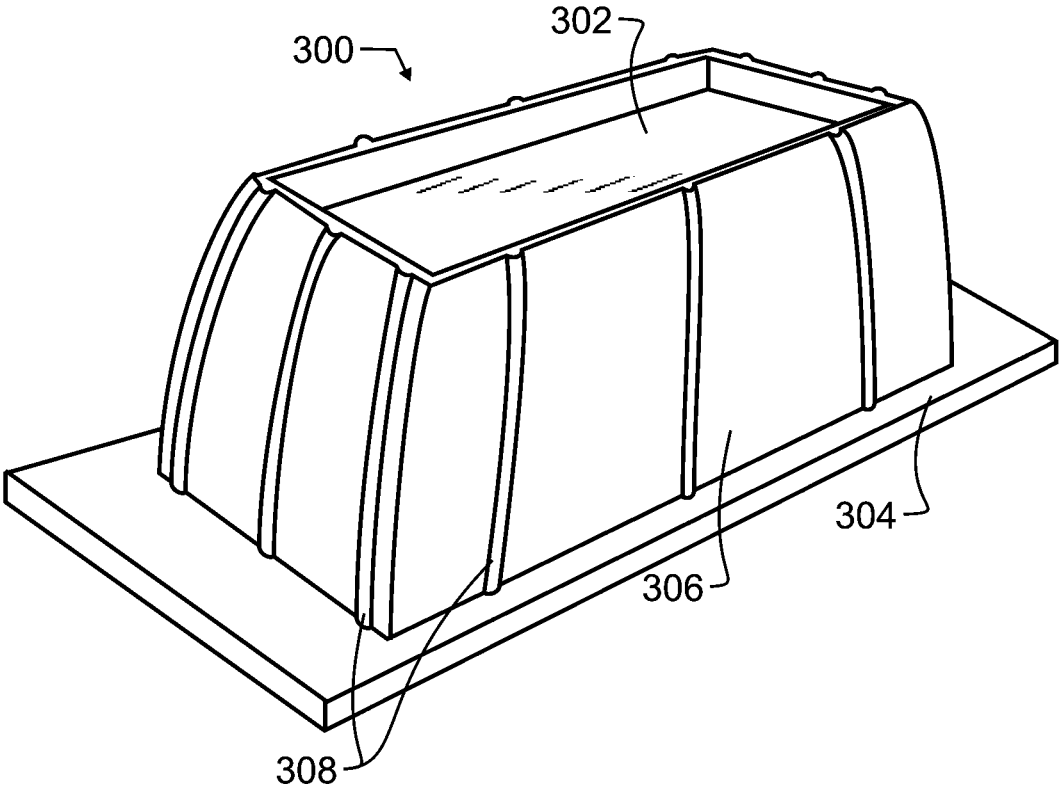
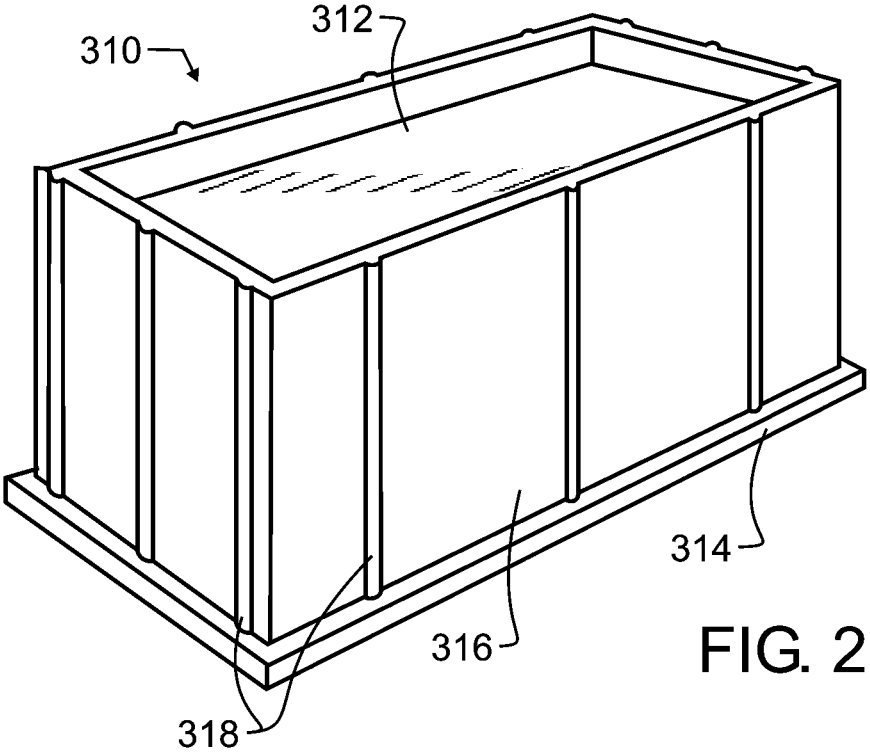
FIG. 27

POLYMER CONSTRUCTION STUDS AND SHEATHING

CROSS REFERENCE TO RELATED APPLICATIONS

The present application claims the benefit of U.S. provisional patent application 63/367,748 filed Jul. 6, 2022, and also the benefit of U.S. provisional patent application 63/296,330 filed Jan. 4, 2022, each of like title and inventorship, the teachings and entire contents which are incorporated herein by reference.

BACKGROUND OF THE INVENTION

1. Field of the Invention

The present invention pertains generally to static structures, for exemplary purposes such as buildings but not solely limited thereto. In more particular manifestations, improved and cost-effective construction components are used to construct a building. These construction components desirably facilitate construction, while also providing enhanced and beneficial characteristics.

2. Description of the Related Art

Wood has long been a preferred material for the construction of buildings. Wood is readily cut to dimension by construction workers at a job site using low cost and much harder steel and carbide saws, is easily and securely fastened using low cost fasteners, is extremely strong for a given weight, resists sag, and is generally low cost. Where wood has been used to construct a building, future remodeling projects are readily accomplished, once again owing to ready cutting and fastening at the job site.

Unfortunately, wood is limited in length to that of the undamaged portions of a tree and to basic shapes that are readily cut at a saw mill. Even when properly cut, the wood may warp or twist during drying or subsequent thereto in response to environmental humidity changes. Wood is also readily damaged by water, fungi, and insects such as termites. Furthermore, wood is not universally available for low cost, particularly in the more arid regions of the world and during periods of high demand. While competing natural products such as steel, stone, cement, bricks, and ceramic tiles have much greater resistance to environmental and insect damage, they are both more expensive to acquire and far more difficult to cut, shape, fasten, and subsequently remodel.

One popular commercial product that has been developed to augment or replace lumber, particularly for exterior decking but for many other projects, is a polymer wood composite (PWC). Exemplary U.S. patents, the teachings which are incorporated herein by reference, include: 6,153,293 by Dahl et al, entitled "Extruded wood polymer composite and method of manufacture"; 6,651,398 by Gregori, entitled "Decking assembly and decking kit with hold-down clip"; and 6,958,185 by Zehner, entitled "Multilayer synthetic wood component".

PWC products combine the inherent strength of wood cellulose with the water, fungi, and insect resistance of plastic by extruding a polymer together with reduced-size wood fibers such as sawdust or chipped wood. Most commonly, PWC is extruded into standard dimensional lumber sizes, and is a solid product. The resulting boards are very heavy, undesirably expensive, and remain susceptible to warpage and degradation over time when in contact with moisture or in very humid environments.

Other artisans have designed plastic products that in at least some embodiments are free of wood entirely, and are likewise intended to augment or replace lumber. Exemplary U.S. patents, the teachings which are incorporated herein by reference, include: 5,783,286 by DiNicola, entitled "Hollow-core plastic structural lumber alternative"; U.S. Pat. Nos. 6,881,367 and 6,890,637 by Baker, entitled "Composite materials, articles of manufacture produced therefrom, and methods for their manufacture"; and 8,065,848 by Carlson et al, entitled "Structural member".

There are a multitude of challenges associated with the use of plastic instead of wood. Primary among these, but not solely limited thereto, are: the greater expense of the plastic material; the difficulties fabricating and cooling the material without sag or warp; maintaining geometry after installation into a building, again without sag or warp; recycling the plastic at the end of the life of a building; and providing suitable fastener adherence to the plastic lumber. One common technique to improve the structural integrity of plastic is to incorporate a filler, typically a fibrous material. One widely used filler is glass fiber, which benefits strength, sag, and warp, and in some cases can also improve fastener adherence. However, glass fiber is very abrasive, and so causes greatly accelerated wear within the manufacturing and building construction equipment. During cutting and drilling, the glass fiber dust can be irritating and hazardous, in some cases endangering the health of the workers and thereby mandating the use of special masks or respirators. Furthermore, at the end of life, fibrous fillers also make recycling far more difficult, if not impossible, since the fibers are extremely difficult or impossible to reasonably separate from the plastic of different composition. Consequently, while the presently available and known wood-free plastic lumber products address some of the challenges, none adequately address all.

In addition to dimensional lumber applications, there are also other applications where plastic compositions will desirably provide alternatives to wood and other building materials. Paneling is one such area. Exemplary U.S. patents, the teachings which are incorporated herein by reference, include: 3,886,705 by Cornland, entitled "Hollow structural panel of extruded plastics material and a composite panel structure formed thereof", 5,294,472 by Arnold et al, entitled "Oblique web multiple surface panels fabricated of aromatic polycarbonates"; 5,706,620 by De Zen, entitled "Thermoplastic structural system and components therefor and method of making same"; 8,590,271 by Thiagarajan et al, entitled "Multi-wall structural components having enhanced radiatransmission capability"; Des 405,545 by Forbis, entitled "Fence plank"; Des 490,544 by Givoni, entitled "Structural panel"; Des 500,370 by Givoni, entitled "Structural panel"; Des 503,000 by Forbis, entitled "Fence panel"; and Des 564,106 by Amato, entitled "Deck panel". These building panels offer similar opportunity and challenges to those described herein above with reference to dimensional lumber.

Additional patents of varying relevance, the relevant teachings and contents which are incorporated herein by reference, include: 3,364,638 by Santangelo, entitled "Composite plastic and corrugated panel"; 3,435,575 by Pottiez, entitled "Process and extruded elements for industrial manufacturing of furniture, furniture components and similar constructions"; 3,450,593 by Fossier et al, entitled "Panel having rims bonded with glass fibers and polyester resin"; 3,662,507 by Espeland, entitled "Preformed building wall construction"; 3,732,138 by Almog, entitled "Panel constructions"; 3,783,563 by Moore, entitled "Prefabricated building components"; 3,819,466 by Winfield et al, entitled "Reinforced and insulating building panel"; 3,948,347 by Rutledge, entitled "Acoustical panel"; 3,974,612 by Karner, entitled "Structural element"; 4,035,536 by Morrison, entitled "Sandwich panel core"; 4,441,291 by Sokoler et al, entitled "Panel, in particular for self-supporting roof structures and self-supporting roof structures assembled of such panels"; 4,606,959 by Hillinger, entitled "Honeycomb panel"; 4,718,213 by Butterfield, entitled "Decorative beam assembly"; 4,749,601 by Hillinger, entitled "Composite structure"; 5,030,662 by Banerjie, entitled "Construction material obtained from recycled polyolefins containing other polymers"; 5,052,164 by Sandow, entitled "Method for manufacturing a panel assembly and structure resulting therefrom"; 5,471,809 by Frankel, entitled "Reinforced plastic structural support member"; 5,789,477 by Nosker et al, entitled "Composite building materials from recyclable waste"; 6,497,956 by Phillips et al, entitled "Structural recycled plastic lumber"; U.S. Pat. Nos. 6,986,934, 7,169,460, 7,211,310, 7,419,717, 7,763,345, 8,021,741, 8,658,274, and 8,834,992 by Chen et al, each entitled "Thermoplastic planks and methods for making the same"; 7,795,329 by Nosker et al, entitled "Use of recycled plastics for structural building forms"; 8,629,221 by Nosker et al, entitled "Compositions and methods of making plastic articles"; 8,752,348 by Bowman, entitled "Composite pre-formed construction articles"; Des 211,517 by Pettler, entitled "Extruded cellular panel for furniture"; Des 423,116 by Gregori, entitled "Decking"; Des 431,658 by Gregori, entitled "Decking"; Des 451,612 by Thibault et al, entitled "Top of a deck member"; Des 453,045 by Ohanesian, entitled "Post for a storage shed"; Des 473,955 by Gregori, entitled "Structural member"; Des 474,286 by Gregori, entitled "Structural member"; Des 485,373 by Morton et al, entitled "Deck plank extrusion"; Des 531,324 by Takagi, entitled "Building board material"; Des 564,678 by Simko, entitled "Construction member"; and Des 585,568 by Kikuchi, entitled "Synthetic board for building purposes".

As may be apparent, in spite of the enormous advancements and substantial research and development that has been conducted, there still remains a need for a cost-effective alternative to wood lumber that preserves the ready cutting and fastening benefits of wood, is recyclable, and is readily cleaned, while overcoming both geometric limitations and susceptibility to environmental and insect damage and warpage.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a building construction stud, comprising a plastic generally contiguous outer wall defining a length, width, depth, cross-section transverse to the length, and an interior, the interior contained substantially within the plastic generally contiguous outer wall; at least one void space longitudinally extensive parallel with the plastic generally contiguous outer wall and contained substantially within the interior; and at least one fastener anchoring and structurally reinforcing member contained substantially within the interior.

In a second manifestation, the invention is, in combination, a building construction stud, a building construction sheathing panel, and at least one fastener affixing the building construction sheathing panel to the building construction stud. The building construction stud comprises a plastic generally contiguous stud outer wall defining a stud length, stud width, stud depth, stud cross-section transverse to the stud length, and a stud interior. The stud interior is contained substantially within the plastic generally contiguous stud outer wall. The plastic stud outer wall has a generally planar first sheathing face parallel with the stud outer wall longitudinal and width axes, a generally planar sheathing second face distal to and generally parallel with the generally planar first sheathing face, a generally planar stud first side wall parallel with the stud outer wall longitudinal and depth axes, a generally planar second side wall distal to and generally parallel with the generally planar first side wall, and at least one void space longitudinally extensive parallel with the plastic generally contiguous stud outer wall and contained substantially within the stud interior. The plastic stud outer wall length is greater than the plastic stud outer wall depth, the plastic generally contiguous stud outer wall cross-section defines a rectangle, and the plastic generally contiguous stud outer wall depth is greater than the plastic generally contiguous stud outer wall width. A plurality of longitudinally extensive stud wall ribs protrude internally from the generally planar first sheathing face. The stud wall ribs are configured to increase stiffness and strength, and also configured to enhance fastener engagement. The at least one fastener penetrates each of the building construction sheathing panel, the generally planar first sheathing face, and the plurality of longitudinally extensive stud wall ribs, and thereby affixes the building construction sheathing panel to the building construction stud.

In a third manifestation, the invention is, in combination, a building construction stud and a building construction stud end cap. The building construction stud comprises a plastic generally contiguous stud outer wall defining a stud length, stud width, stud depth, stud cross-section transverse to the stud length, and a stud interior, the stud interior contained substantially within the plastic generally contiguous stud outer wall. At least one void space is longitudinally extensive parallel with the plastic generally contiguous stud outer wall and is contained substantially within the stud interior. A generally planar first sheathing face is parallel with the stud outer wall longitudinal and width axes. A generally planar second sheathing face is distal to and generally parallel with the generally planar first sheathing face. A generally planar first stud side wall is parallel with the stud outer wall longitudinal and depth axes. A generally planar second stud side wall is distal to and generally parallel with the generally planar first stud side wall. The building construction stud end cap comprises a terminating cap orthogonal to and abutted with each of the generally planar first sheathing face, the generally planar second sheathing face, the generally planar first stud side wall, and the generally planar second stud side wall. At least one end cap side wall rises from the terminating cap and is inserted within the stud interior. An end cap top face is bordered by the at least one end cap side wall and is distal to the terminating cap.

OBJECTS OF THE INVENTION

Exemplary embodiments of the present invention solve inadequacies of the prior art by providing a homogenous and unitary plastic building construction stud having a plastic generally contiguous outer wall; at least one void space longitudinally extensive parallel with the plastic generally contiguous outer wall and contained substantially within the interior; and at least one fastener anchoring and structurally reinforcing member contained substantially within the interior.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide improved and cost-effective construction components that are used to construct a building. As a corollary thereto, it is an object of the invention to require less material for a given length and strength requirement, which is beneficial both in cost of materials and also during manufacturing, since less material generally cools more quickly. A second object of the invention is for those construction components to facilitate on-site building construction and remodeling by being readily and safely cut and otherwise worked by construction workers, and readily cleaned when so required. As a corollary thereto, it is an object of the present invention to use a material that is not hazardous to a construction worker during building construction. Another object of the present invention is to reduce susceptibility to environmental and insect damage. A further object of the invention is for those construction components to be readily recycled at the end of building life. Yet another object of the present invention is to provide suitable fastener adherence.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 26 illustrates a preferred embodiment stud cap from a projected view.

FIG. 27 illustrates an alternative embodiment stud cap from a projected view.

DESCRIPTION OF THE PREFERRED EMBODIMENT

Manifested in the preferred embodiment, the present invention provides a polymer construction component having a generally contiguous outer wall, at least one and preferably a plurality of longitudinally extensive hollow portions or void spaces within the outer wall, and a structurally reinforcing and fastener anchoring internal web that in some embodiments divides and thereby defines the hollow portions.

Figure 1:
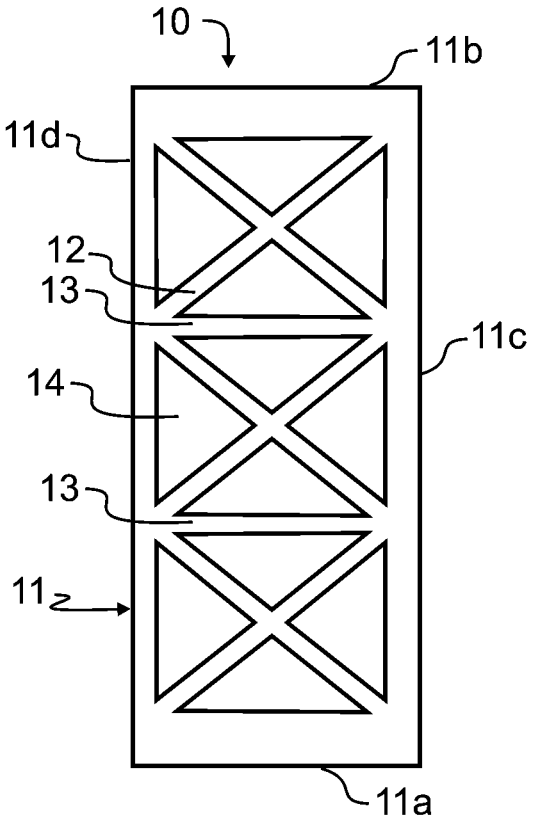
FIG. 1 illustrates a preferred embodiment polymer construction stud designed in accord with the teachings of the present invention from an end view.
Figure 3:
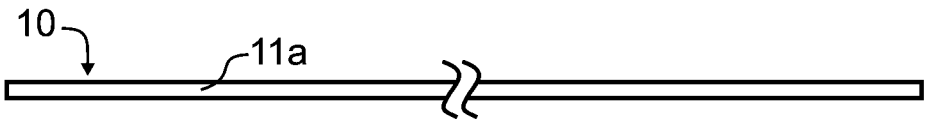
FIG. 3 illustrates the preferred embodiment construction stud of FIG. 1 from a side view.

In a preferred embodiment of the invention illustrated in FIGS. 1 and 3, a construction stud 10 is comprised of an outer wall 11, at least one secondary fastener anchoring and internal reinforcing member 12, and a void space 14. In this preferred embodiment, at least two secondary fastener anchoring and internal reinforcing members 12 are provided, and arranged to define an X-shaped cross-section therebetween, creating a semi-open profile with excellent strength to weight ratio.

While illustrated as having substantially constant thickness, outer wall 11 will in some embodiments be slightly thicker on narrower longitudinally extensive faces than on the wider faces. In those embodiments, the additional wall thickness will be selected to assist with the securement of nails and screws. Again for exemplary and non-limiting purpose, a 2×4 dimensional stud has actual dimensions of 1.5×3.5 inches. The 1.5 inch faces are normally in contact with walls, ceilings, and the like. Consequently, fasteners securing drywall or other paneling or sheathing will pass through the 1.5 inch face. The extra thickness on the 1.5 inch face will then provide a somewhat more secure attachment. As referenced in FIG. 1, outer wall 11 includes a generally planar first sheathing face 11*a* that is parallel to the outer wall longitudinal and width axes. A generally planar sheathing second face 11*b* is distal to and generally parallel with the generally planar first sheathing face 11*a*. Side walls 11*c*, 11*d* are perpendicular to the first and second sheathing faces 11*a*, 11*b*, and comprise generally planar faces parallel with the outer wall 11 longitudinal and depth axes.

These aforementioned definitions of width and depth axes are provided merely for convenience in communicating the various faces of outer wall 11, and are chosen herein to correspond to a building wall when stud 10 is being used as a vertical wall stud. In such case, the building wall height axis is parallel to the outer wall 11 longitudinal axis, the building wall width axis is parallel to the outer wall 11 width axis, and the building wall depth or thickness axis is parallel to the outer wall 11 depth axis. Nevertheless, such designations are for convenience and understanding only, and will be understood to not be limiting to the present invention in any way.

The interior of preferred embodiment construction stud 10 comprises two secondary fastener anchoring and internal reinforcing members 12 arranged in an X-pattern, creating four void spaces 14 each of a triangular prism geometry. In preferred embodiment construction stud 10, spaces 14 between internal reinforcing members 12 are open to the atmosphere. While not preferred for a number of reasons, including more difficult initial fabrication, more difficult installation by construction workers, and much more difficult recycling at end-of-building-life, in some alternative embodiments these spaces are filled with suitable solid or foamed material, for exemplary and non-limiting purposes including wood, resins and plastics, metals, ceramics or cementitious materials, or even combinations or composites of the above. In yet further alternative embodiments, only portions of these spaces are filled with additional material, such as at the ends or at periodic or predetermined intermediate locations.

Internal reinforcing members 12 help to reduce the transfer of heat and sound, while also improving upon strength to weight ratios. Furthermore, these internal reinforcing members 12 provide a second anchor point for fasteners installed into preferred embodiment construction stud 10. This is extremely beneficial for ensuring that the fasteners are securely anchored, by providing extra grip that helps to prevent the fastener from backing out. While a single pair of internal reinforcing members 12 arranged in an X-pattern could in some embodiments be sufficient, preferred embodiment construction stud 10 instead is provided with three pairs of internal reinforcing members 12, each pair arranged in an X-pattern. Each pair is separated from an adjacent pair by a cell divider and internal reinforcing member 13 that both adds reinforcing strength to preferred embodiment construction stud 10 and divides the interior of preferred embodiment construction stud 10 into several smaller sections.

One particularly noteworthy benefit of subdividing the internal space within preferred embodiment construction stud 10 is that a fastener of reasonable length is much more likely to not only penetrate outer wall 11, but also penetrate at least one and potentially several of the internal reinforcing members 12, 13. As already noted above, achieving this is extremely beneficial for ensuring that the fasteners are and remain securely anchored.

Preferred embodiment construction stud 10 is preferably fabricated entirely and solely from plastic, including virgin or recycled content in any suitable combination, and is particularly suited for inner, non-load bearing applications. In a most preferred embodiment, the plastic composition that forms the bulk of stud 10 is homogenous and uniform, which greatly facilitates recycling. Nevertheless, it will also be understood that even in some of the most preferred embodiments where the bulk of stud 10 is homogenous and uniform, nominal surface coatings, treatments, or finishes of different composition or lacking homogeneity or uniformity with respect to the bulk of stud 10 will also be applied.

A benefit of plastic is that it is not always subject to the same degree and timing of price fluctuation as wood and other natural materials. Additionally it can be completely recyclable, particularly where used internally and so not exposed to consequential amounts of ultra-violet light. A preferred material can be ground and reused or recycled for alternative products or fill for concrete, either when salvaging construction remnants or from a years later tear down or remodeling of a building. As a result, in some life cycles the plastic may present a potential carbon offset. Plastic also is not a food source to pest insects and fungi, nor does it have a problem with water exposure or warpage with moisture content or humidity changes. The plastic also is readily washed and cleaned on site. This makes plastic particularly desirable in areas where there is much rainfall, high water tables, other risks of moisture or water infiltration or exposure, insect activity, or a lack of available wood.

Nevertheless, in some alternative embodiments there will be requirements or objectives that will result in such alternative embodiments containing plastic admixed with other materials. For exemplary and non-limiting purpose, some load-bearing applications may benefit from incorporation of glass or other reinforcing fiber.

In some embodiments, to facilitate securement of preferred embodiment construction stud 10 adjacent the ends, caps are provided that embrace and enhance the ends and adjacent structure to which the stud is affixed. Preferred caps are illustrated in FIGS. 26 and 27 described herein below. In other embodiments, where predetermined lengths that will not be further cut are known and required, the ends are filled or reinforced with extra material. In yet other embodiments, where predetermined lengths, including cuts to intermediate lengths, are known and required, intermediate portions of void space 14 are selectively filled or otherwise reinforced to accommodate a plurality of predetermined potential lengths used or needed at a job site.

Various embodiments of apparatus designed in accord with the present invention have been illustrated in the various figures. The embodiments are distinguished by the hundreds and tens digit, and various components within each embodiment designated by the ones digit. However, many of the components are alike or similar between embodiments, so numbering of the ones digits have been maintained wherever possible, such that identical, like or similar functions may more readily be identified between the embodiments. If not otherwise expressed, those skilled in the art will readily recognize the similarities and understand that in many cases like numbered ones digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description. In addition, various alternative embodiments will illustrate features that will be understood to be applicable to other embodiments, the relevance and desirability of which will be readily determined by a person of reasonable skill in the art upon a review of the present disclosure.

Figure 2:
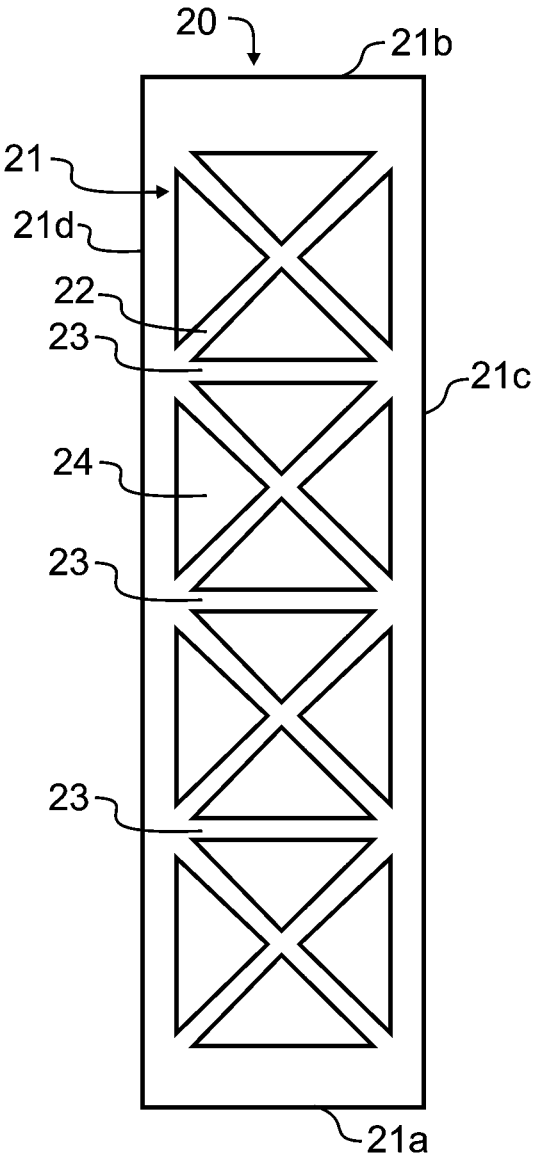
FIG. 2 illustrates a first alterative embodiment construction stud from an end view.

FIG. 1 illustrates the profile view or open end view of a preferred embodiment construction stud 10 such as might be fabricated into the familiar 2×4 dimensional lumber geometry. FIG. 2 illustrates a similar profile view or open end view of an alternative embodiment construction stud 20 such as might be fabricated into the familiar 2×6 dimensional lumber geometry. While the two embodiments are otherwise very similar, owing to the greater 5.5 inch dimension the alternative embodiment construction stud 20 has a total of four cells, each having pairs of internal reinforcing members 22 arranged in an X-pattern. Each pair is separated from an adjacent pair by a cell divider and internal reinforcing member 23, with a total of three of these depicted.

FIG. 3 illustrates the simple rectangular side view of preferred embodiment construction stud 10, showing the generally planar first sheathing face 11*a* and in this view with stud 10 laid horizontally on the page. While as illustrated the length of preferred embodiment construction stud 10 is indeterminate, typical standard lengths for exemplary and non-limiting purpose may be 96 inches, 120 inches, and 144 inches. The side view of alternative embodiment construction stud 20 is identical thereto.

Figure 4:
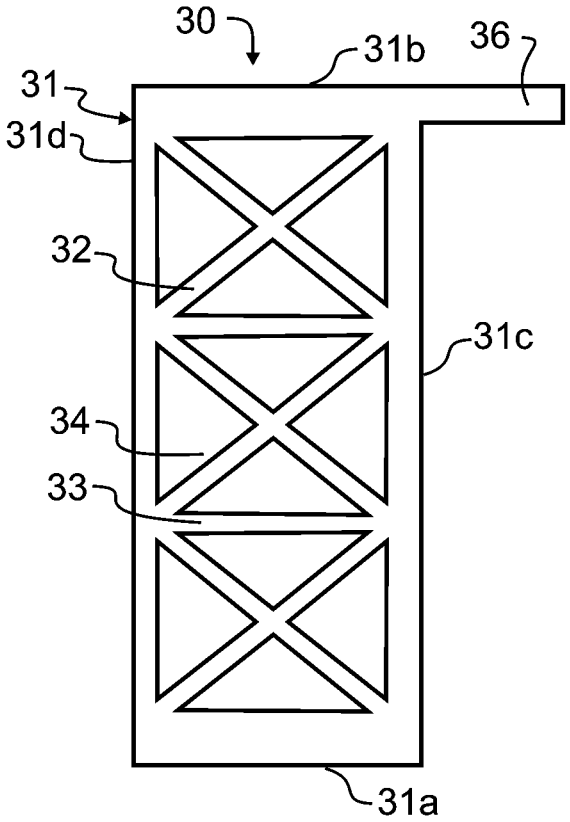
FIG. 4 illustrates a second alternative embodiment construction stud from an end view.
Figure 5:
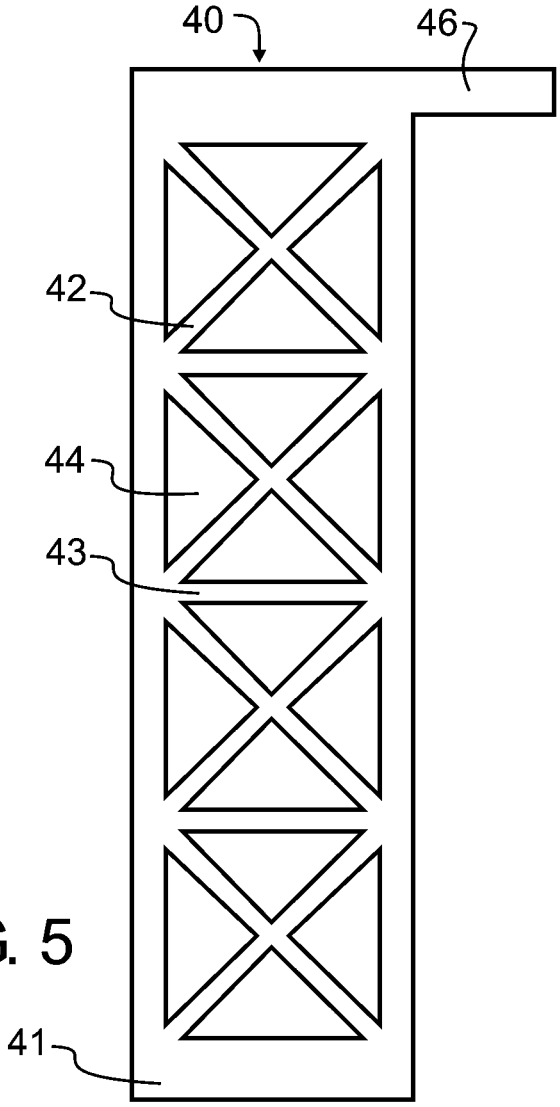
FIG. 5 illustrates a third alternative embodiment construction stud from an end view.
Figure 6:
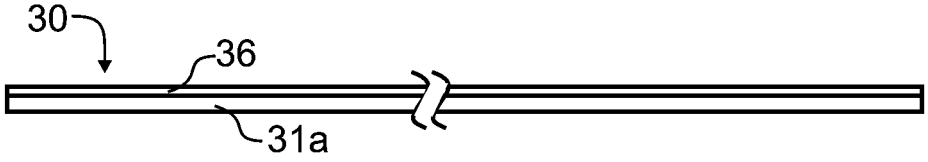
FIG. 6 illustrates the second alternative embodiment construction stud of FIG. 4 from a side view.

FIGS. 4 and 6 illustrate a second alternative embodiment construction stud 30. While most of the components are similar or like to those of preferred embodiment construction stud 10, second alternative embodiment construction stud 30 additionally includes a tab 36 which can be used to eliminate the need for a stud in a corner installation. The second alternative embodiment construction stud 30 and third alternative embodiment construction stud 40 illustrated in FIG. 5 each have this tab, 36, 46, respectively, extending in the plane of the 1.5 inch face. This tab 36, 46 eliminates a stud in the corner by creating the proper spacing and contact for drywall or the like in the corners.

Figure 7:
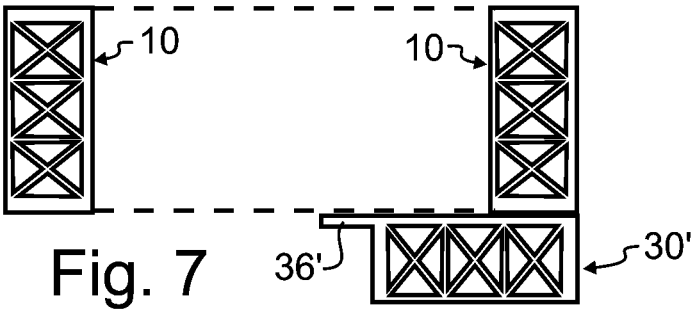
FIG. 7 illustrates a fourth alternative embodiment construction stud and corner for a wall from a top view.

FIG. 7 illustrates a fourth alternative embodiment construction stud 30' similar to that of FIG. 4, and so is not numbered separately, but with the tab 36' still originating at the corner between the planes of the 1.5 and 3.5 inch faces. However, in this fourth alternative embodiment construction stud 30' the tab is running parallel to the plane of the 3.5 inch face. Once again, this tab 36' is configured to eliminate a stud in the corner by creating the proper spacing and contact for drywall or the like in the corners.

Figure 8:
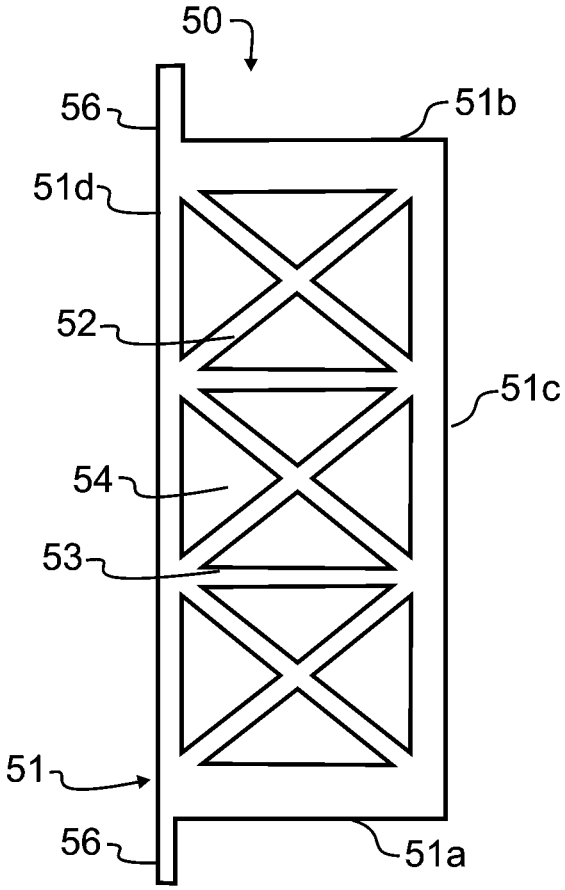
FIG. 8 illustrates a fifth alternative embodiment construction stud from an end view.
Figure 9:
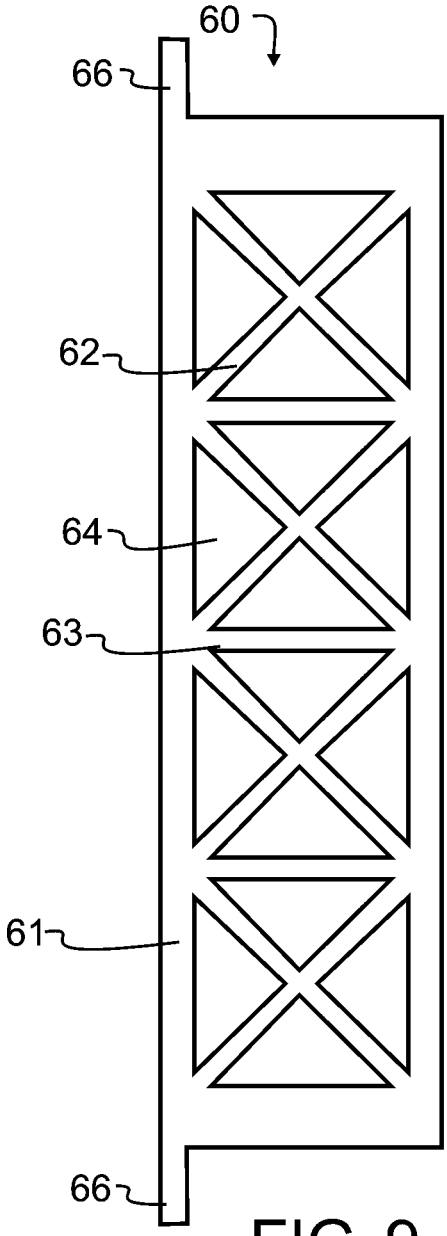
FIG. 9 illustrates a sixth alternative embodiment construction stud from an end view.
Figure 10:
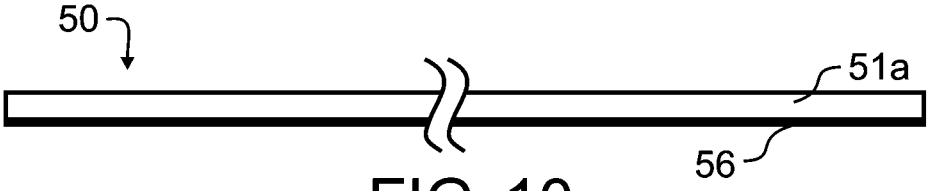
FIG. 10 illustrates the fifth alternative embodiment construction stud of FIG. 8 from a side view.

FIGS. 8 and 10 illustrate a fifth alternative embodiment construction stud 50. While most of the components once again are similar or like to those of preferred embodiment construction stud 10, fifth alternative embodiment construction stud 50 is designed as a top stud, and so includes a pair of tabs 56. Tabs 56 are provided extending in the plane of the side walls 51*c* and 51*d*, and allow drywall to butt into the stud and provide space for trusses or ceiling joists to shrink and contract. The fifth alternative embodiment construction stud 50 and sixth alternative embodiment construction stud 60 illustrated in FIGS. 8 and 9, respectively, each have this tab, 56, 66, respectively, extending in the plane of the side walls.

Figure 11:
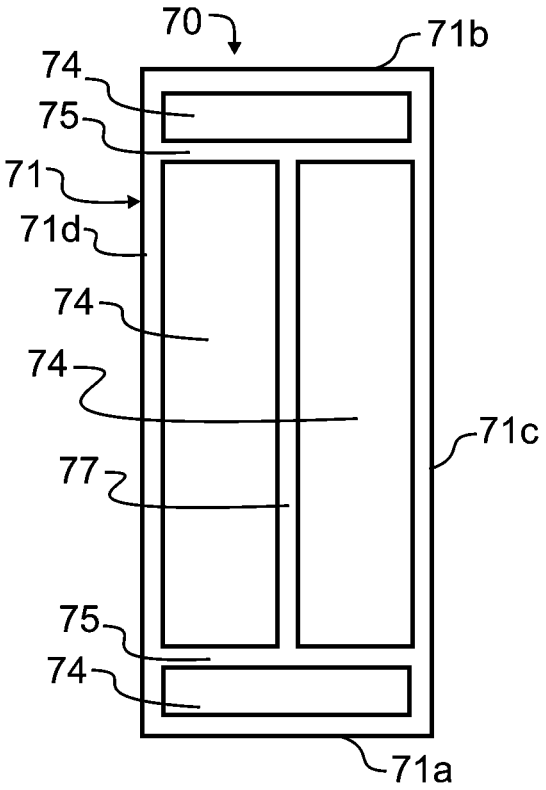
FIG. 11 illustrates a seventh alternative embodiment construction stud from an end view.
Figure 12:
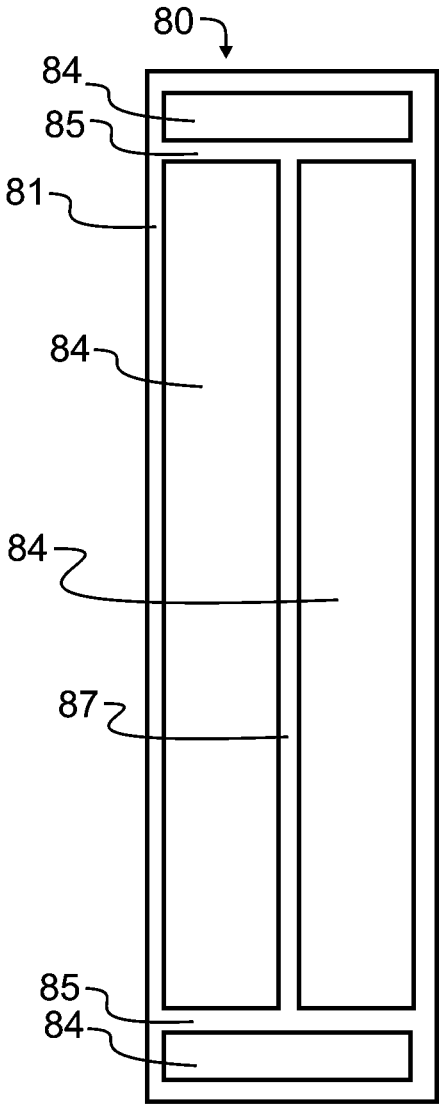
FIG. 12 illustrates an eighth alternative embodiment construction stud from an end view.
Figure 13:
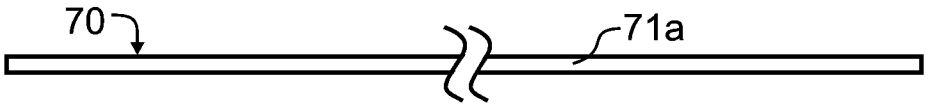
FIG. 13 illustrates the seventh alternative embodiment construction stud of FIG. 11 from a side view.

FIGS. 11 and 13 illustrate a seventh alternative embodiment construction stud 70. In this embodiment, the secondary fastener anchoring structure and internal reinforcing 12 and cell divider and internal reinforcing member 13 of preferred embodiment construction stud 10 has been replaced by an "I" geometry internal structure, including two internal reinforcing members 75 that extend in a plane approximately parallel and relatively near to the respective generally planar first and second sheathing faces 71*a*, 71*b*. A long central internal reinforcing member 77 extends in a plane roughly centered between and parallel with the two side walls 71*c*, 71*d*. In this seventh alternative embodiment construction stud 70, a fastener driven into stud 70 from the generally planar first sheathing face 71*a* will pass first through outer wall 71, then through a small void 74, and then will penetrate through an adjacent internal reinforcing member 75. As already described herein above, this will significantly help to assure that nails, screws, and other fasteners have lasting retention. Eighth alternative embodiment construction stud 80 has very similar internal reinforcing members in the geometry of an "I", but in an exemplary 2×6 format rather than the exemplary 2×4 format of FIG. 11.

Figure 14:
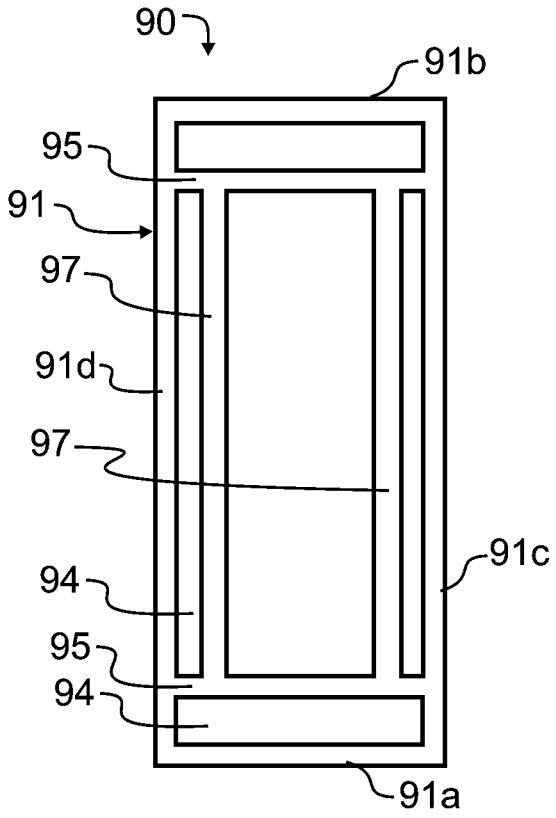
FIG. 14 illustrates a ninth alternative embodiment construction stud from an end view.
Figure 15:
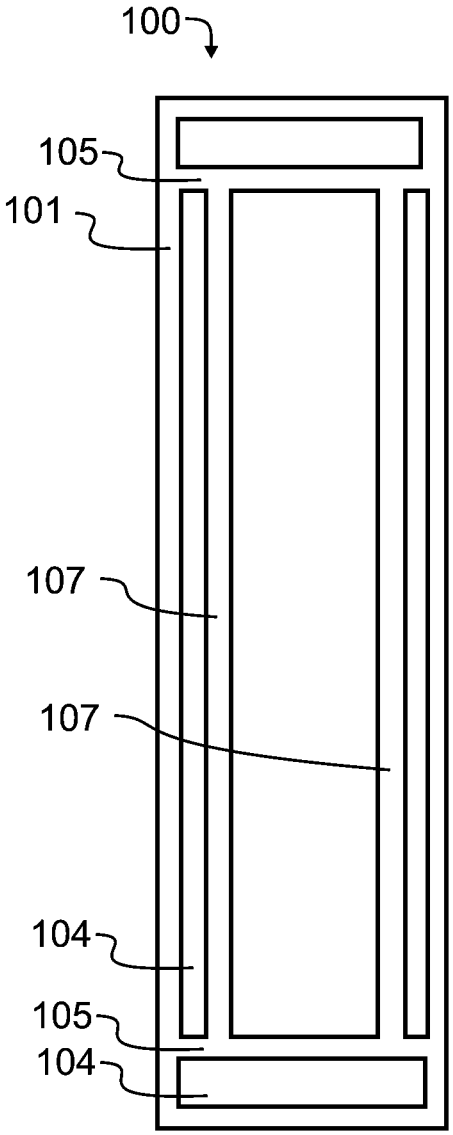
FIG. 15 illustrates a tenth alternative embodiment construction stud from an end view.
Figure 16:
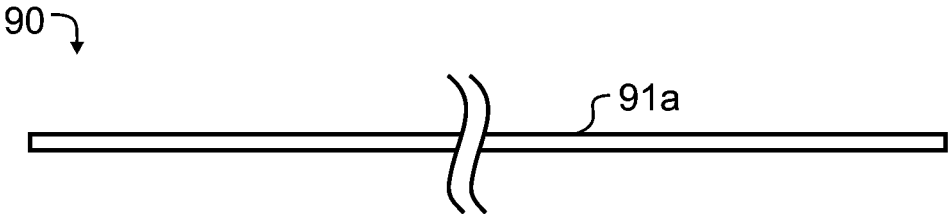
FIG. 16 illustrates the ninth alternative embodiment construction stud of FIG. 14 from a side view.

The ninth alternative embodiment construction stud 90 illustrated in FIGS. 14 and 16, and the tenth alternative embodiment construction stud 100 illustrated in FIG. 15 each have geometry similar to those of the seventh alternative embodiment construction stud 70. However, instead of having a single long centrally located internal reinforcing member 77, ninth alternative embodiment construction stud 90 has a pair of long internal reinforcing members 97 each spaced a relative small distance from a most adjacent side wall 91*c*, 91*d*. These construction studs 90, 100 provide greatly improved fastener retention irrespective of whether the fastener is driven from a sheathing face 91*a*, 91*b*, 101*a*, 101*b*, or from a side wall 91*c*, 91*d*, 101*c*, 101*d*.

Figure 17:
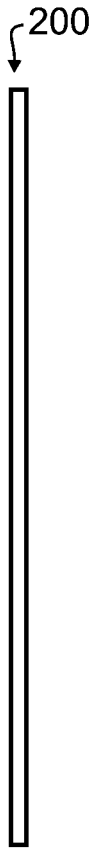
FIG. 17 illustrates a preferred embodiment construction sheathing panel from an edge view.
Figure 18:
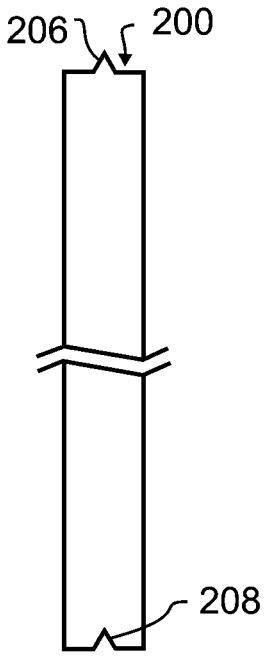
FIG. 18 illustrates the preferred embodiment construction sheathing panel of FIG. 17 from an enlarged edge view, depicting the tongue and groove provided along opposed edges.
Figure 21:
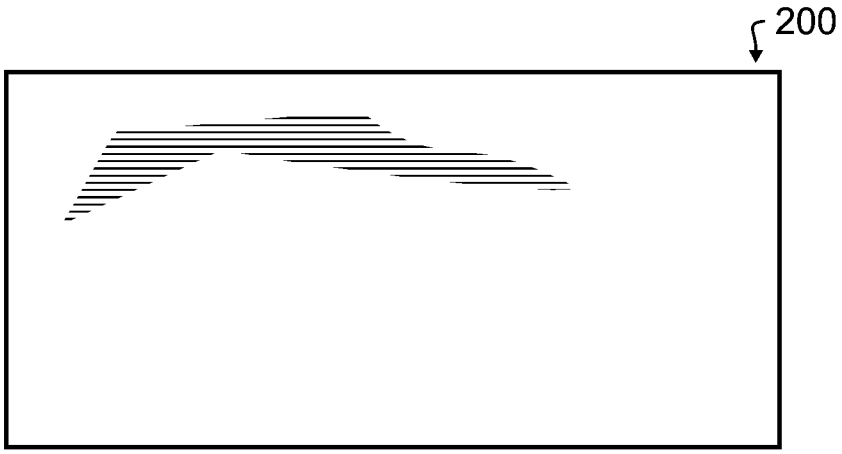
FIG. 21 illustrates the preferred embodiment construction sheathing panel of FIG. 17 from a front elevational view.

FIGS. 17, 18, and 21 illustrate a preferred embodiment construction sheathing panel 200. As depicted, panel 200 has a basic sheet-like geometry, of relatively large length and width, with a relatively much smaller thickness or depth. For exemplary and non-limiting purpose, exemplary dimensions for preferred embodiment construction sheathing 200 will include: 4'×8'×½ "or ⅝" for walls and flooring; or 2'×12'×½" for ceilings. As best visible in FIG. 18, preferred embodiment construction sheathing panel 200 preferably includes a tongue 206 and mating groove 208 provided along opposed edges, most commonly the lengthwise edges. Tongue 206 and groove 208 work in the known manner, enabling an installer to abut sheets next to each other in a better secured and sealed interlocking manner. While not illustrated, in some embodiments a construction sheathing panel designed in accord with the teachings of the present invention has fluting to support structural requirements.

Figure 19:
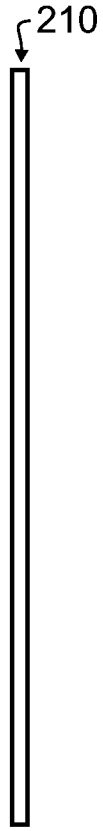
FIG. 19 illustrates a first alternative embodiment construction sheathing panel from an edge view.
Figure 20:
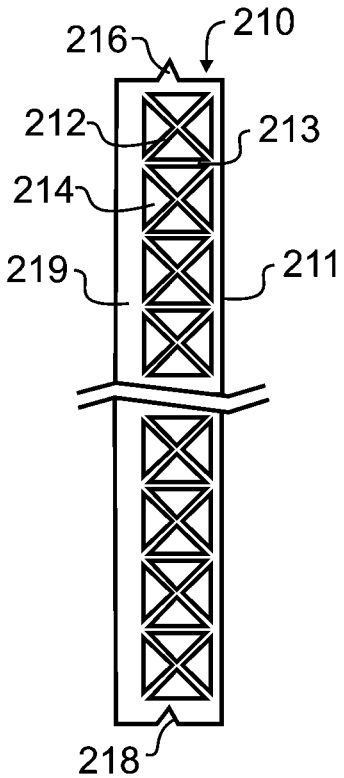
FIG. 20 illustrates the first alternative embodiment construction sheathing panel of FIG. 19 from an enlarged end view, depicting the tongue and groove provided along opposed edges and the internal reinforcing members.

FIGS. 19 and 20 illustrate a first alternative embodiment construction sheathing panel 210, having a like or similar tongue 216 and mating groove 218. However, in this first alternative embodiment construction sheathing panel 210, an interior geometry resembling that of preferred embodiment construction stud 10 is preferably provided. An outer wall 211 forms an outer perimeter about a plurality of cells defined by cell divider and internal reinforcing members 213, and within each cell is provided a pair of secondary fastener anchoring structure and internal reinforcing members 212, each which function in like manner to the similar components found in preferred embodiment construction stud 10. In some embodiments, including first alternative embodiment construction sheathing panel 210, a thicker exterior face 219 may be provided, as required or desired for a particular application. In other embodiments, outer wall 211 will instead be of constant thickness throughout.

While the preferred and alternative embodiment studs may be of any suitable opacity, construction sheathing panels 200, 210 are preferentially transparent or translucent. This allows a carpenter or other person building a structure to save time by being able to see studs such as preferred embodiment construction stud 10 through the sheathing, and to subsequently fasten to the stud without needing to measure and estimate the stud location and blindly fasten. In addition to the transparency or translucence of the paneling, the sheathing in most embodiments also will be paintable to enable opaqueness, custom coloring or decorating, and to reduce or prevent ultraviolet damage to the plastic. This also provides potential labor savings, by reducing the need for taping and covering of sheet rock with paint and texture.

Figure 22:
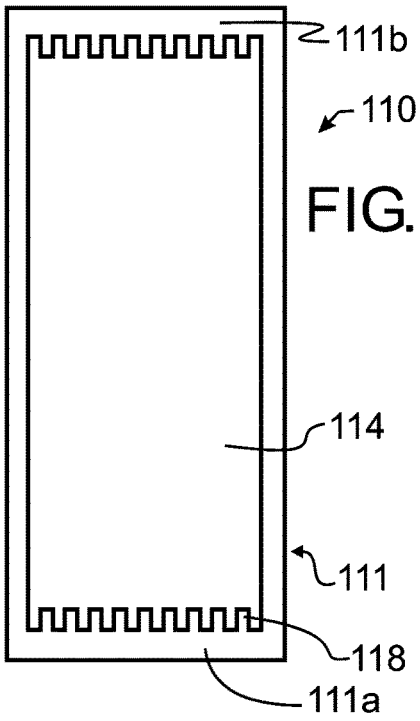
FIG. 22 illustrates an eleventh alternative embodiment construction stud from an end view.
Figure 24:
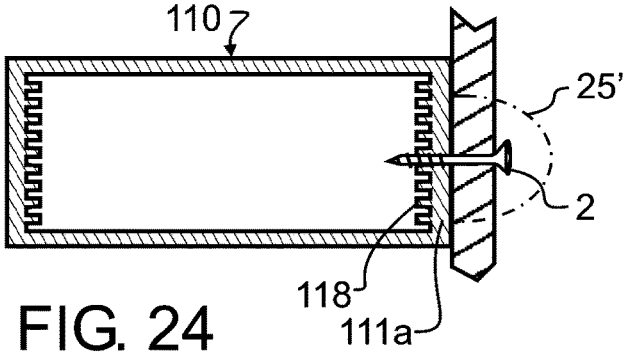
FIG. 24 illustrates the eleventh alternative embodiment construction stud from a horizontal section view where a screw attaches sheeting to the stud.
Figure 25:
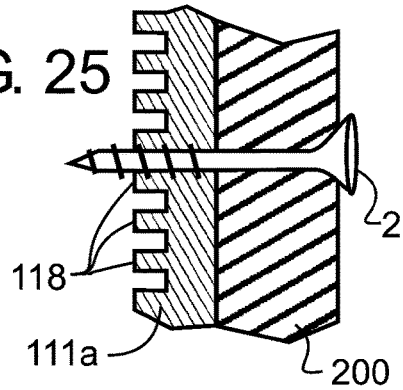
FIG. 25 illustrates an enlarged partial section view of FIG. 24.

An eleventh alternative embodiment construction stud 110 is illustrated in FIGS. 22, 24, and 25. Instead of having a spanning internal reinforcing member, this eleventh alternative embodiment construction stud 110 provides internally protruding wall ribs 118 that provide an increased stiffness and strength without increasing the entire wall thickness, thereby keeping the overall weight and material consumption to a minimum. Wall ribs 118 are illustrated in FIGS. 22, 24, and 25 as being provided only on the sheathing faces 111*a*, 111*b*, which are the surfaces to which drywall or paneling will be attached. Nevertheless, in some alternative embodiments more and fewer internal faces of stud 110 will be provided with wall ribs 118.

Figure 25A:
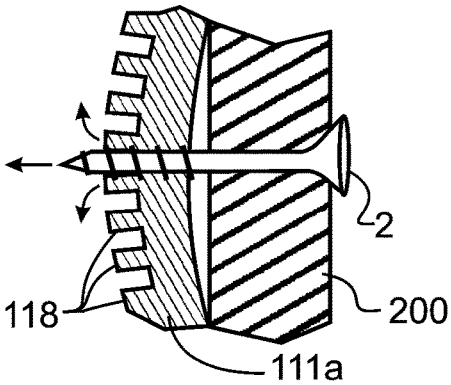
FIG. 25*a* illustrates the enlarged partial section view of FIG. 25, with force applied driving the fastener into the wall stud and thereby spreading the ribs.

As illustrated in FIG. 25*a*, which is grossly exaggerated to convey what would otherwise be hard to visually communicate, when a fastener such as screw 2 or in alternative embodiments a nail or other penetrating fastener is driven into sheathing face 111*a*, both sheathing face 111*a* and wall ribs 118 will be pushed and thereby flex or deform toward the opposing sheathing face 111*b*. This flexure means sheathing face 111*a* will tend to are such that the portions of wall ribs 118 most protruding into the interior of stud 110 will spread apart from adjacent like portions of wall ribs 118. This net effect of spreading apart adjacent wall ribs 118 will allow fastener 2 to penetrate into stud 110 with minimal additional interference from the wall ribs 118, relatively easier than if there were no flexure in first sheathing face 111*a*.

Figure 25B:
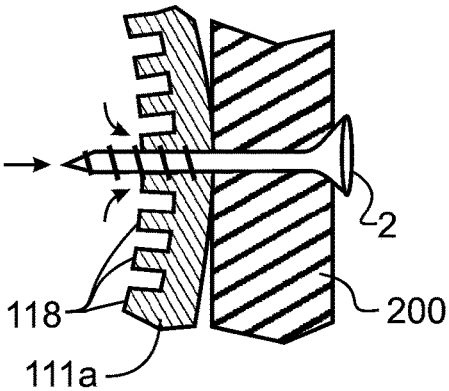
FIG. 25*b* illustrates the enlarged partial section view of FIG. 25, with force applied pulling the fastener out from the wall stud and thereby contracting the ribs about the fastener.

However, as illustrated in FIG. 25*b*, which is also grossly exaggerated to convey what would otherwise be hard to visually communicate, when a fastener such as screw 2 is pulled away from stud 110, such as when a force is applied that might tend to pull out drywall, sheeting 200, or other objects anchored to stud 110, the resulting force will tend to cause sheathing face 111*a* to arc away from the opposing sheathing face 111*b*. This movement, even if slight, will cause each of the portions of wall ribs 118 most protruding into the center of stud 110 to be pulled closer together to adjacent like portions of wall ribs 118. This net effect of pulling together adjacent wall ribs 118 will increase the force required to pull a fastener out from stud 110, thereby creating additional interference from wall ribs 118. Consequently, the addition of wall ribs 118 increases the force required to insert a fastener by less than these same wall ribs increase the force required to withdraw or pull out a fastener from stud 110. In addition, these wall ribs require both less material and less overall weight than if the outer walls of stud 110 were simply made thicker.

As will be appreciated, in some embodiments each of the materials, dimensions and overall geometry of wall ribs 118, first sheathing face 111*a*, and fastener 2 can be varied to meet the needs of a particular application. For exemplary and non-limiting purpose, the width of the valleys between protruding teeth as well as the width of the protruding teeth can each be increased or decreased such as would be appropriate to work most optimally with a particular size or type of fastener.

Figure 23:
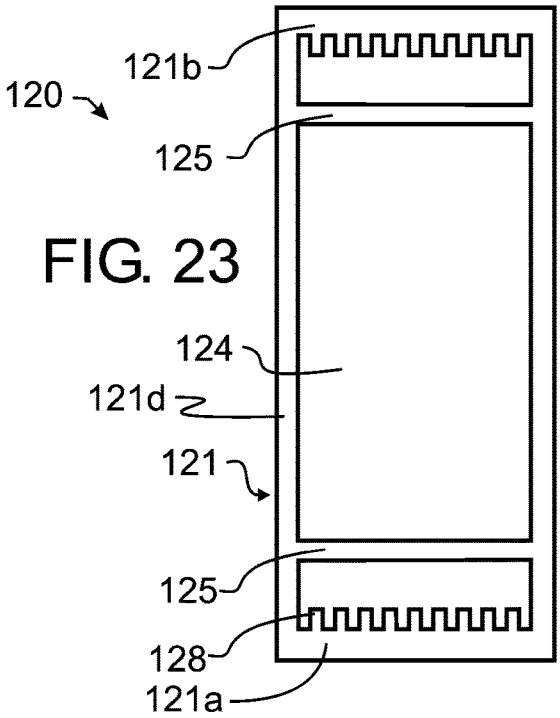
FIG. 23 illustrates a twelfth alternative embodiment construction stud from an end view.

Twelfth alternative embodiment construction stud 120 illustrated in FIG. 23 incorporates wall ribs 128 having like geometry and function to wall ribs 118. These wall ribs 121 are further combined together with a pair of internal reinforcing members 125 each spaced a relatively small distance from an adjacent ribbed wall 121. Internal reinforcing members 125 have like geometry and function to internal reinforcing member 75 of seventh alternative embodiment construction stud 70, and so stud 120 provides even greater holding force and structural rigidity. As may be apparent, these construction studs 110, 120 provide improved fastener retention.

FIGS. 26 and 27 illustrate preferred and alternative embodiment stud caps 300, 310. In these embodiments, both stud caps 300, 310 have a solid body that caps the terminal end(s) of a stud. For exemplary purpose, stud cap 300 is configured to terminate stud 120, while stud cap 310 is configured to terminate stud 110. When properly placed into the end of a stud, as will be described herein below, fasteners can be driven into the solid core of the stud cap, allowing a carpenter to install fasteners from nearly any direction or angle, as is common practice with wood studs.

Both have similar features, including a top face 302, 312; side walls 306, 316; ribs 308, 318; and terminating caps 304, 314. As aforementioned, in preferred embodiments of stud end caps 300, 310 the volume within the space defined by top face 302, 312; side walls 306, 316; and terminating caps 304, 314 is solid. Nevertheless, in some alternative embodiments there will be a limited air space, and in yet other alternative embodiments there will be a predetermined web similar to internal reinforcing members such as 12, 13, 75, and 77.

As is apparent from an inspection of the two FIGS. 26 and 27, side walls 316 define a volume that extends across almost the entire terminating cap 314, leaving just a small lip or overhang of terminating cap 314 exposed in FIG. 27. This small lip or overhang is configured to engage with outer wall 111 when stud cap 310 is fully and properly inserted into the end of stud 110, thereby preventing stud cap 310 from dropping into stud 110 beyond terminating cap 314. Since stud 120 has additional internal reinforcing members 125 that reduce the open void space 124 to a cross-section smaller than that of void 114, side walls 306 leave a much bigger lip or overhang on terminating cap 304 exposed.

In addition, side walls 316 form orthogonal planes with respect to top face 312 and terminating cap 314. In contrast, side walls 306 are not planar, and top face 302 is slightly smaller as a result. Ribs 318 are configured to engage with the interior of outer walls 111, creating slight plastic deformation therebetween in the manner of a cork in a bottle to ensure a good solid fit therebetween. However, and as with a cork, the slightly smaller top face 302 allows this face to be inserted more easily and with less precise alignment before ribs 308 will engage with outer walls 121, making installation somewhat less difficult.

The features that distinguish stud end caps 300, 310 from each other are provided for exemplary purpose and are not mutually exclusive. In other words, and solely for exemplary and non-limiting purpose, in some alternative embodiments the larger lip defined by terminating cap 304 will be used in combination with planar and orthogonally arranged side walls 316. Further, while stud end caps 300, 310 each are illustrated having a top face 302, 312 that is generally planar and parallel to terminating caps 304, 314, in some alternative embodiments top faces 302, 312 are provided with notches or cut-outs that correspond to the internal webbing created by such features as: the secondary fastener anchoring structure and internal reinforcing member 12, 22, 32, 42, 52, 62, 72, 82, 92, 102; cell divider and internal reinforcing member 13, 23, 33, 43, 53, 63; internal reinforcing members 75, 85, 95, 105, 125; long central internal reinforcing members 77, 87, 97, 107; and wall ribs 118, 128.

As may be apparent from the foregoing, various embodiments of the present invention utilize only plastic building components. There are two primary components to the plastic building materials, the first is a structural stud, the second is sheathing. Both of these structures include an exterior wall, and are hollow with additional internal reinforcing material that serves as both structural reinforcement and improves fastener retention. The combination of exterior wall, internal reinforcing material, and voids therein slows the transfer of heat, and sound, while also providing good strength to weight ratios and less material usage. Furthermore, the material being used is only plastic, the benefits of which have been thoroughly described herein above.

The specific plastic used has many requirements. The first is that the type of plastic used will most preferably have low sag. Sag is the cold flowing of the plastic which results in permanent deformation of the plastic. Furthermore, the plastic will preferably interact with chosen fasteners in such manner to prevent the fasteners, screws and nails for exemplary and non-limiting purpose, from releasing or retracting while the structure is loaded by such events as: opening and closing doors and windows; ordinary bumps and bangs into a wall; and in the case of load-bearing installations, wind, rain, and snow.

While the foregoing details what is felt to be the preferred embodiment of the invention, no material limitations to the scope of the claimed invention are intended. Further, features and design alternatives that would be obvious to one of ordinary skill in the art are considered to be incorporated herein. For exemplary and non-limiting purpose, while dimensions have been presented herein above to aid in an understanding of the potential applications of the present invention, it will be understood that any suitable dimensions will be used as determined to be suitable by a designer. The scope of the invention is set forth and particularly described in the claims herein below.

I claim:

1. A building construction stud, consisting essentially of:

a plastic contiguous outer wall defining a length, width, depth, cross-section transverse to said length, a longitudinal axis, a width axis, a depth axis and an interior, said interior contained substantially within said plastic contiguous outer wall, said plastic outer wall having a planar first sheathing face parallel with said outer wall longitudinal and width axes, a planar second sheathing face distal to and parallel with said planar first sheathing face, a planar first side wall parallel with said outer wall longitudinal and depth axes, and a planar second side wall distal to and parallel with said planar first side wall;

at least one void space longitudinally extensive parallel with said plastic contiguous outer wall and contained substantially within said interior;

a plurality of longitudinally extensive wall ribs each emanating from said outer wall and protruding internally into said at least one void space from said outer wall, said wall ribs configured to increase stiffness and strength, and also configured to enhance engagement with a plurality of fasteners; and at least one fastener anchoring and structurally reinforcing member contained substantially within said interior.

2. The building construction stud of claim 1, wherein said at least one fastener anchoring and structurally reinforcing member is unitary with said plastic contiguous outer wall.

3. The building construction stud of claim 1, wherein said plastic contiguous outer wall and said at least one fastener anchoring and structurally reinforcing member comprise a homogenous composition.

4. The building construction stud of claim 1, wherein said plurality of fasteners comprises a plurality of screws.

5. The building construction stud of claim 1, wherein said plurality of fasteners comprises a plurality of nails.

6. The building construction stud of claim 1, wherein said plastic outer wall length is greater than said plastic outer wall depth, said plastic contiguous outer wall cross-section defines a rectangle, and said plastic contiguous outer wall depth is greater than said plastic contiguous outer wall width.

7. The building construction stud of claim 6, wherein said plurality of longitudinally extensive wall ribs protrude internally into said at least one void space from said planar first sheathing face.

8. The building construction stud of claim 6, wherein said at least one fastener anchoring and structurally reinforcing member is contained substantially within and divides said interior into a plurality of void spaces.

9. The building construction stud of claim 8, further comprising:

a first cell divider and internal reinforcing member intermediate between said planar first sheathing face and said planar sheathing second face and more adjacent to said planar first sheathing face than to said planar sheathing second face; and a second cell divider and internal reinforcing member intermediate between said first cell divider and said planar sheathing second face.

10. A building construction system, comprising:

a building construction stud, a building construction sheathing panel, and a plurality of fasteners affixing said building construction sheathing panel to said building construction stud, said building construction stud comprising:

a plastic contiguous stud outer wall defining a stud length, stud width, stud depth, stud cross-section transverse to said stud length, a longitudinal axis, a width axis, a depth axis and a stud interior, said stud interior contained substantially within said plastic contiguous stud outer wall, said plastic stud outer wall having a planar first sheathing face parallel with said stud outer wall longitudinal and width axes, a planar sheathing second face distal to and parallel with said planar first sheathing face, a planar stud first side wall parallel with said stud outer wall longitudinal and depth axes, a planar second side wall distal to and parallel with said planar first side wall, and at least one void space longitudinally extensive parallel with said plastic contiguous stud outer wall and contained substantially within said stud interior, wherein said plastic stud outer wall length is greater than said plastic stud outer wall depth, said plastic contiguous stud outer wall cross-section defines a rectangle, and said plastic contiguous stud outer wall depth is greater than said plastic contiguous stud outer wall width;

a plurality of longitudinally extensive stud wall ribs protruding internally from said planar first sheathing face, said stud wall ribs configured to increase stiffness and strength, and also configured to enhance fastener engagement; and at least one fastener anchoring and structurally reinforcing member contained substantially within said stud interior;

said plurality of fasteners penetrating each of said building construction sheathing panel, said planar first sheathing face, and said plurality of longitudinally extensive stud wall ribs, and thereby affixing said building construction sheathing panel to said building construction stud.

11. The building construction system of claim 10, wherein said wall ribs emanate from and protrude internally from said stud outer wall into said at least one void space.

12. The building construction system of claim 10, wherein said planar first sheathing face and said plurality of longitudinally extensive stud wall ribs are configured to flex toward said planar sheathing second face when said plurality of fasteners initially penetrate said planar first sheathing face and said plurality of longitudinally extensive stud wall ribs, thereby spreading adjacent ones of said longitudinally extensive stud wall ribs apart.

13. The building construction system of claim 10, wherein said planar first sheathing face and said plurality of longitudinally extensive stud wall ribs are configured to flex away from said planar sheathing second face when said plurality of fasteners is pulled away from said planar sheathing second face, thereby pulling closer adjacent ones of said longitudinally extensive stud wall ribs and thereby increasing a force required to remove said plurality of fasteners from said building construction stud.

14. The building construction system of claim 10, wherein said plurality of fasteners comprises a plurality of screws.

15. The building construction system of claim 10, wherein said plurality of fasteners comprises a plurality of nails.

16. The building construction system of claim 10, wherein said at least one fastener anchoring and structurally reinforcing member is contained substantially within and dividing said interior into a plurality of void spaces, said at least one plurality of fasteners simultaneously penetrating each of said building construction sheathing panel, said planar first sheathing face, said plurality of longitudinally extensive stud wall ribs, and said at least one fastener anchoring and structurally reinforcing member.

17. The building construction system of claim 16, wherein said at least one fastener anchoring and structurally reinforcing member comprises a planar first fastener anchoring and structurally reinforcing member parallel with and adjacent to said planar first sheathing face and distal to said planar sheathing second face.

18. The building construction system of claim 17, wherein said at least one fastener anchoring and structurally reinforcing member comprises a planar second fastener anchoring and structurally reinforcing member parallel with and adjacent to said planar sheathing second face and distal to said planar first sheathing face.

19. The building construction system of claim 18, wherein said planar first fastener anchoring and structurally reinforcing member and said planar second fastener anchoring and structurally reinforcing member divide said interior into at least three void spaces.

* * * * *